United States Patent [19]

Sequeira, Jr. et al.

[11] 4,167,452

[45] Sep. 11, 1979

[54] CONTROL SYSTEM FOR AN N-METHYL-2-PYRROLIDONE REFINING UNIT RECEIVING MEDIUM SOUR CHARGE OIL

[75] Inventors: Avilino Sequeira, Jr.; Frank L. Barger, both of Port Arthur, Tex.

[73] Assignee: Texaco Inc., White Plains, N.Y.

[21] Appl. No.: 952,896

[22] Filed: Oct. 19, 1978

[51] Int. Cl.[2] ..... C10G 21/00; C06G 7/58

[52] U.S. Cl. ..... 196/14.52; 364/497; 364/501; 422/62

[58] Field of Search ..... 196/14.52; 422/62; 23/230 A; 364/497, 501

[56] References Cited

U.S. PATENT DOCUMENTS

| | | | |
|---|---|---|---|
| 3,799,871 | 3/1974 | Sequeira, Jr. | 196/14.52 |
| 3,911,259 | 10/1975 | Huddleston et al. | 364/501 |
| 3,972,779 | 3/1976 | Harrison | 196/14.52 |
| 4,053,744 | 10/1977 | Woodle | 196/14.52 |

*Primary Examiner*—R. E. Serwin

*Attorney, Agent, or Firm*—Thomas H. Whaley; Carl G. Ries; Ronald G. Gillespie

[57] ABSTRACT

A solvent refining unit treats medium sour charge oil with an N-methyl-2-pyrrolidone solvent, hereafter referred to as MP, in an extractor to yield raffinate and extract mix. The MP is recovered from the and from the extract mix and returned to the refining extractor. A system controlling the refining unit includes a gravity analyzer, a sulfur analyzer, a refractometer and viscosity analyzers; all analyzing the medium sour charge oil and providing corresponding signals, sensors sense the flow rates of the charge oil and the MP flowing into the extractor and the temperature of the extract mix and provide corresponding signals. One of the flow rates of the medium sour charge oil and the MP flow rates is controlled in accordance with the signals from all the analyzers, the refractometer and all the sensors, while the other flow rate of the medium sour charge oil and the MP flow rates is constant.

9 Claims, 13 Drawing Figures

CONTROL SYSTEM FOR AN N-METHYL-2-PYRROLIDONE REFINING UNIT RECEIVING MEDIUM SOUR CHARGE OIL

BACKGROUND OF THE INVENTION

1. Field of the Invention

The present invention relates to control systems and methods in general and, more particularly, to control systems and methods for oil refining units.

2. Summary of the Invention

A solvent refining unit treats medium sour charge oil with an N-methyl-2-pyrrolidone solvent, hereafter referred to as MP, in an extractor to yield raffinate and extract mix. The MP is recovered from the raffinate and from the extract mix and returned to the extractor. A system controlling the refining unit includes a gravity analyzer, a sulfur analyzer, a refractometer and viscosity analyzers. The analyzers analyze the medium sour charge oil and provide corresponding signals. Sensors sense the flow rates of the charge oil and the MP flowing into the extractor and the temperature of the extract mix and provide corresponding signals. The flow rate of the medium sour charge oil or the MP is controlled in accordance with the signals provided by all the sensors, the refractometer and the analyzers while the other flow rate of the medium sour charge oil and the MP flow rates is constant.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

Figure 1:
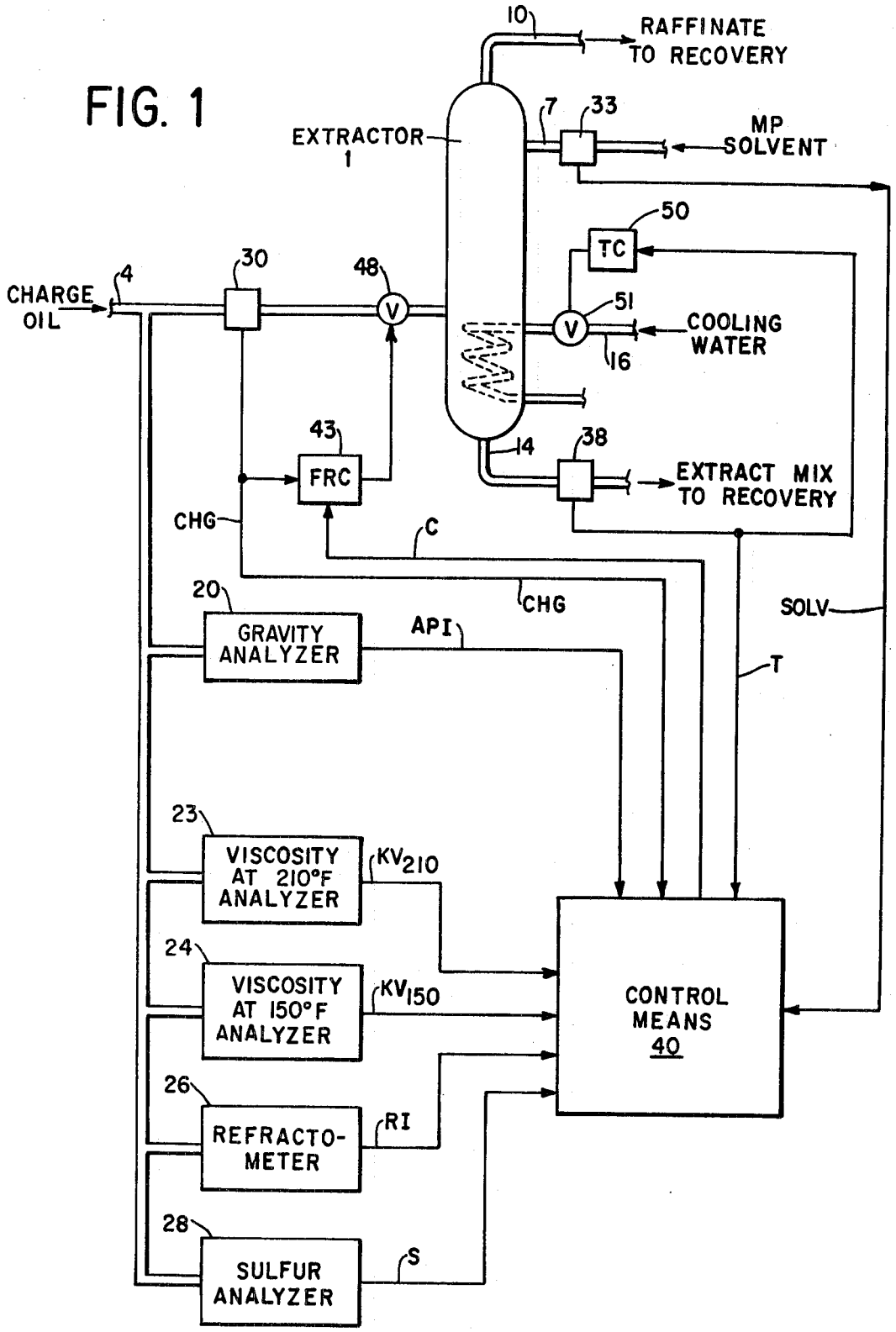
FIG. 1 shows a solvent refining unit in partial schematic form and a control system, constructed in accordance with the present invention, in simple block diagram form.

An extractor 1 in a solvent refining unit is receiving medium sour charge oil by way of a line 4 and N-methyl-2-pyrrolidone solvent, hereafter referred to as MP, by way of a line 7 and providing raffinate to recovery by way of a line 10, which is further processed to yield refined oil, and an extract mix to recovery by way of a line 14.

Medium sour charge oil is a charge oil having a sulfur content greater than a predetermined sulfur content and having a kinematic viscosity, corrected to a predetermined temperature, less than a first predetermined kinematic viscosity but equal to or less than a second predetermined kinematic viscosity. Preferably, the predetermined sulfur content is 1.0%, the predetermined temperature is 210° F., and the first and second predetermined kinematic viscosities are 7.0 and 15.0, respectively. The temperature in extractor 1 is controlled by cooling water passing through a line 16. A gravity analyzer 20, viscosity analyzers 23 and 24, a refractometer 26 and a sulfur analyzer 28 sample the charge oil in line 4 and provide signals API, $KV_{210}$, $KV_{150}$, RI and S, respectively, corresponding to the API gravity, the kinematic viscosities at 210° F. and 150° F., the refractive index and sulfur content, respectively.

A flow transmitter 30 in line 4 provides a signal CHG corresponding to the flow rate of the charge oil in line 4. Another flow transmitter 33 in line 7 provides a signal SOLV corresponding to the MP flow rate. A temperature sensor 38, sensing the temperature of the extract mix leaving extractor 1, provides a signal T corresponding to the sensed temperature. All signals hereinbefore mentioned are provided to control means 40.

Control means 40 provides signal C to a flow recorder controller 43. Recorder controller 43 receives signals CHG and C and provides a signal to a valve 48 to control the flow rate of the charge oil in line 4 in accordance with signals CHG and C so that the charge oil assumes a desired flow rate. Signal T is also provided to temperature controller 50. Temperature controller 50 provides a signal to a valve 51 to control the amount of cooling water entering extractor 1 and hence the temperature of the extract-mix in accordance with its set point position and signal T.

The following equations are used in practicing the present invention for medium sour charge oil:

$$H_{210}=\ln\ln(KV_{210}+C_1) \quad (1)$$

where $H_{210}$ is a viscosity H value for 210° F., $KV_{210}$ is the kinetic viscosity of the charge oil at 210° F. and $C_1$ is a constant having a preferred value of 0.7.

$$H_{150}=\ln\ln(KV_{150}+C_1) \quad (2)$$

where $H_{150}$ is a viscosity H value for 150° F., and $KV_{150}$ is the kinematic viscosity of the charge oil at 150° F.

$$K_{150}=[C_2-\ln(T_{150}+C_3]/C_4 \quad (3)$$

where $K_{150}$ is a constant needed for estimation of the kinematic viscosity at 100° F., $T_{150}$ is 150, and $C_2$ through $C_4$ are constants having preferred values of 6.5073, 460 and 0.17937, respectively.

$$H_{100}=H210+(H_{150}-H_{210})/K_{150} \quad (4)$$

where $H_{100}$ is a viscosity H value for 100° F.

$$KV_{100}=\exp[\exp(H_{100})]-C_1 \quad (5)$$

where $KV_{100}$ is the kinematic viscosity of the charge oil at 100° F.

$$SUS=C_5(KV_{210})+[C_6+C_7(KV_{210})]/[C_8+C_9(KV_{210})+C_{10}(KV_{210})^2+C_{11}(KV_{210})^3](C_{12}) \quad (6)$$

where SUS is the viscosity in Saybolt Universal Seconds and $C_5$ through $C_{12}$ are constants having preferred values of 4.6324, 1.0, 0.03264, 3930.2, 262.7, 23.97, 1.646 and $10^{31\ 5}$, respectively.

$$SUS_{210}=[C_{13}+C_{14}(C_{15}-C_{16})]SUS \quad (7)$$

where $SUS_{210}$ is the viscosity in Saybolt Universal Seconds at 210° F. and $C_{13}$ through $C_{16}$ are constants having preferred values of 1.0, 0.000061, 210 and 100, respectively.

$$VI_{DWCO}=C_{17}-C_{18}(VI)+C_{19}(S)^2-C_{20}(RI)-(API)+C_{21}(API)(VI)-C_{22}(API)(S) \quad (8)$$

where $VI_{DWCO}$ is the viscosity of the dewaxed medium sour charge oil having a pour point of 0° F. and $C_{17}$ through $C_{22}$ are constants having preferred values of 838.96, 11.504, 3.1748, 19.19, 0.42412 and 0.38322, respectively.

$$VI_{DWCP}=VI_{DWCO}+(Pour)[C_{23}-C_{24}\ln SUS_{210}+C_{25}(\ln SUS_{210})^2] \quad (9)$$

where $VI_{DWCP}$ and Pour are the viscosity index of the dewaxed product at a predetermined pour point temperature and the pour point of the dewaxed product, respectively, and $C_{23}$ through $C_{25}$ are constants having preferred values of 2.856, 1.18 and 0.126, respectively.

$$\Delta VI=VI_{RO}-V_{DWCO}=VI_{RP}-VI_{DWCP}, \quad (10)$$

where $VI_{RO}$ and $VI_{RP}$ are the VI of the refined oil at 0° F., pour and the predetermined temperature, respectively.

$$\Delta RI=[C_{26}-C_{27}(\Delta VI)-C_{28}(KV_{210})^2+C_{29}(VI)^2-C_{30}(KV_{210})(API)+C_{31}(\Delta VI)(KV_{210})+C_{32}(API)(S)-C_{33}(VI)(S)-C_{34}(\Delta VI)^2]C_{35} \quad (11)$$

where ΔRI is the change in the refractive index from the charge oil to the raffinate, VI is the viscosity index of the medium sour charge oil and $C_{26}$ through $C_{35}$ are constants having preferred values of 386.48, 14.544, 1.4528, 0.01232, 1.4923, 2.4913, 27.217, 8.3297, 0.056978 and $10^{31\ 4}$, respectively.

$$J=C_{36}+C_{37}(\Delta RI)+C_{38}(S)^2-C_{39}(VI)^2+C_{40}(T)^2+C_{41}(S)(T)-C_{42}(KV_{210})(T)-C_{43}(S)-C_{44}(\Delta RI)(T)+C_{45}(\Delta RI)(\Delta VI), \quad (12)$$

where J is the MP dosage and $C_{36}$ through $C_{45}$ are constants having preferred values of 690.21, 51327, 115.13, 0.078784, 0.034373, 3.7926, 0.41528, 974.48, 404.34 and 218.61.

$$C=(SOLV)(100)/J, \quad (13)$$

where C is the new charge oil flow rate.

Figure 2:
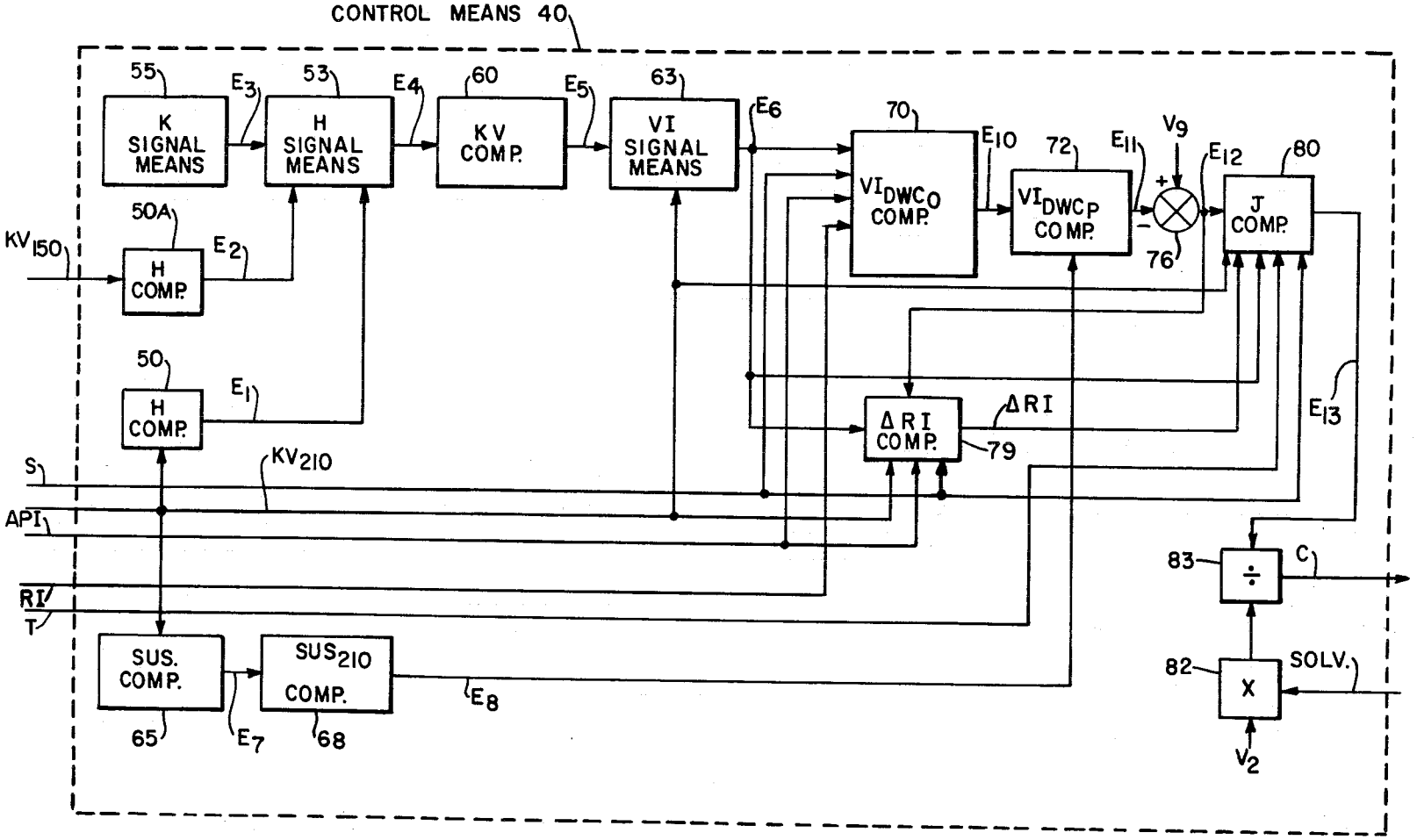
FIG. 2 is a detailed block diagram of the control means shown in FIG. 1.

Referring now to FIG. 2, signal $KV_{210}$ is provided to an H computer 50 in control means 40, while signal $KV_{150}$ is applied to an H computer 50A. It should be noted that elements having a number and a letter suffix are similar in construction and operation as to those elements having the same numeric designation without a suffix. All elements in FIG. 2, except elements whose operation is obvious, will be disclosed in detail hereinafter. Computers 50 and 50A provide signals $E_1$ and $E_2$ corresponding to $H_{210}$ and $H_{150}$, respectively, in equations 1 and 2, respectively, to H signal means 53. K signal means 55 provides a signal $E_3$ corresponding to the term $K_{150}$ in equation 3 to H signal means 53. H signal means 53 provides a signal $E_4$ corresponding to the term $H_{100}$ in equation 4 to a KV computer 60 which provides a signal $E_5$ corresponding to the term $KV_{100}$ in accordance with signal $E_4$ and equation 5 as hereinafter explained.

Signals $E_5$ and $KV_{210}$ are applied to VI signal means 63 which provides a signal $E_6$ corresponding to the viscosity index.

An SUS computer 65 receives signal $KV_{210}$ and provides a signal $E_7$ corresponding to the term SUS in accordance with the received signals and equation 6 as hereinafter explained.

An SUS 210 computer 68 receives signal $E_7$ and applies signal $E_8$ corresponding to the term $SUS_{210}$ in accordance with the received signal and equation 7 as hereinafter explained.

A $VI_{DWCO}$ computer 70 receives signal RI, S, API, and $E_6$ and provides a signal $E_{10}$ corresponding to the term $VI_{DWCO}$ in accordance with the received signals and equation 8. Subtracting means 76 performs the function of equation 10 by subtracting signal $E_{11}$ from a direct current voltage $V_9$, corresponding to the term $VI_{RP}$, to provide a signal $E_{12}$ corresponding to the term ΔVI in equation 10.

A ΔRI computer 79 receives signals $E_6$, $E_{12}$, $KV_{210}$, S and API and provides a signal ΔRI, corresponding to the term ΔRI in equation 11, in accordance with received signals and equation 11 as hereinafter explained.

A J computer 80 receives signals T, $KV_{210}$, S, ΔRI, $E_6$ and $E_{12}$ and provides a signal $E_{13}$ corresponding to the term J in accordance with the received signals and equation 12 as hereinafter explained to a divider 83.

Signal SOLV is provided to a multiplier 82 where it is multiplied by a direct current voltage $V_2$ corresponding to a value of 100 to provide a signal corresponding to the term (SOLV)(100) in equation 13. The product signal is applied to divider 83 where it is divided by signal $E_{13}$ to provide signal C corresponding to the desired new charge oil flow rate.

It would be obvious to one skilled in the art that if the charge oil flow rate was maintained constant and the MP flow rate varied, equation 13 would be rewritten as $$SO=(J)(CHG)/100 \quad (14)$$

where SO is the new MP flow rate. Control means 40 would be modified accordingly.

Figure 3:
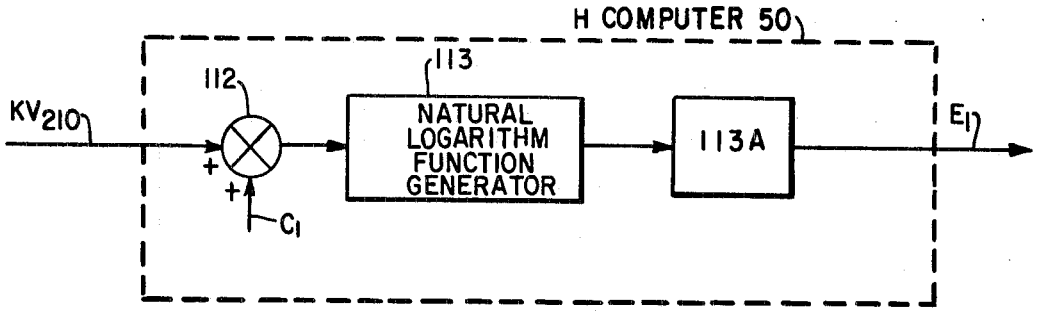
FIGS. 3 through 13 are detailed block diagrams of the H computer, the K signal means, the H signal means, the KV computer, the VI signal means, the SUS computer, the $SUS_{210}$ computer, the $VI_{DWCO}$ computer, the $VI_{DWCP}$ computer, the ΔRI computer and the J computer, respectively, shown in FIG. 2.

Referring now to FIG. 3, H computer 50 includes summing means 112 receiving signal $KV_{210}$ and summing it with a direct current voltage $C_1$ to provide a signal corresponding to the term $[KV_{210}+C_1]$ shown in equation 1. The signal from summing means 112 is applied to a natural logarithm function generator 113 which provides a signal corresponding to the natural log of the sum signal which is then applied to another natural log function generator 113A which in turn provides signal $E_1$.

Figure 4:
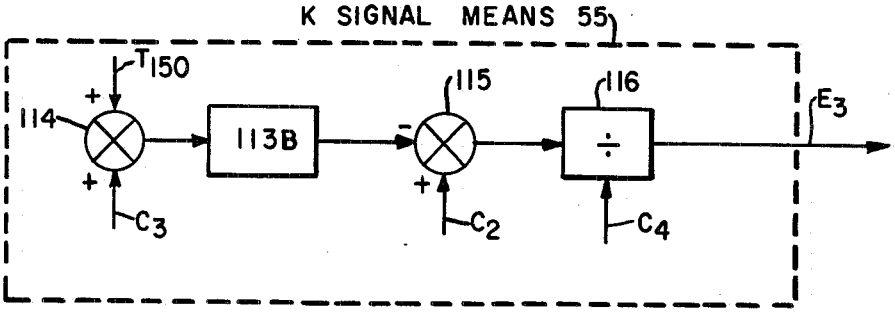

Referring now to FIG. 4, K signal means 55 includes summing means 114 summing direct current voltage $T_{150}$ and $C_3$ to provide a signal corresponding to the term $[T_{150}+C_3]$ which is provided to a natural log function generator 113B which in turn provides a signal corresponding to the natural log of the sum signal from summing means 114. Subtracting means 115 subtracts the signal provided by function generator 113B from a direct current voltage $C_2$ to provide a signal corresponding to the numerator of equation 3. A divider 116 divides the signal from subtracting means 115 with a direct current voltage $C_4$ to provide signal $E_3$.

Figure 5:
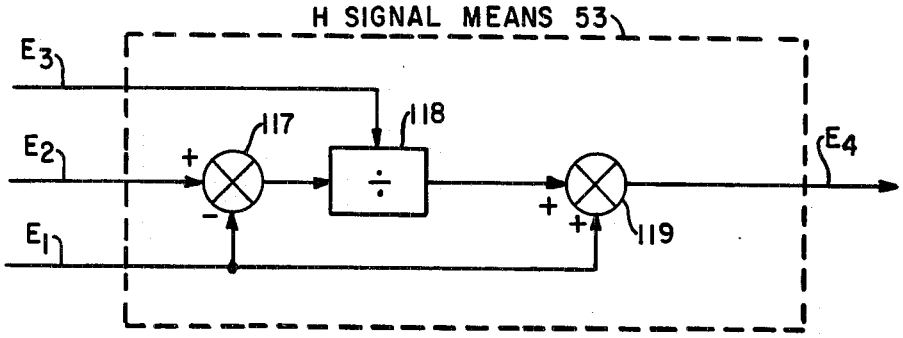

Referring now to FIG. 5, H signal means 53 includes subtracting means 117 which subtracts signal $E_1$ from signal $E_2$ to provide a signal corresponding to the term $H_{150}-H_{210}$, in equation 4, to a divider 118. Divider 118 divides the signal from subtracting means 117 by signal $E_3$. Divider 118 provides a signal which is summed with signal $E_1$ by summing means 119 to provide signal $E_4$ corresponding to $H_{100}$.

Figure 6:
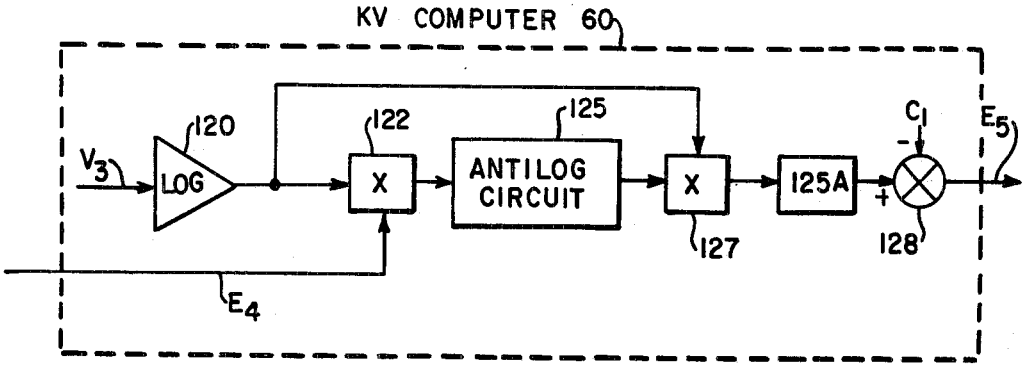

Referring now to FIG. 6, a direct current voltage $V_3$ is applied to a logarithmic amplifier 120 in KV computer 60. Direct current voltage $V_3$ corresponds to the mathematical constant e. The output from amplifier 120 is applied to a multiplier 122 where it is multiplied with signal $E_4$. The product signal from multiplier 122 is applied to an antilog circuit 125 which provides a signal corresponding to the term exp ($H_{100}$) in equation 5. The signal from circuit 125 is multiplied with the output from logarithmic amplifier 120 by a multiplier 127 which provides a signal to antilog circuit 125A. Circuit 125A is provided to subtracting means 128 which subtracts a direct current voltage $C_1$ from the signal from circuit 125A to provide signal $E_5$.

Figure 7:
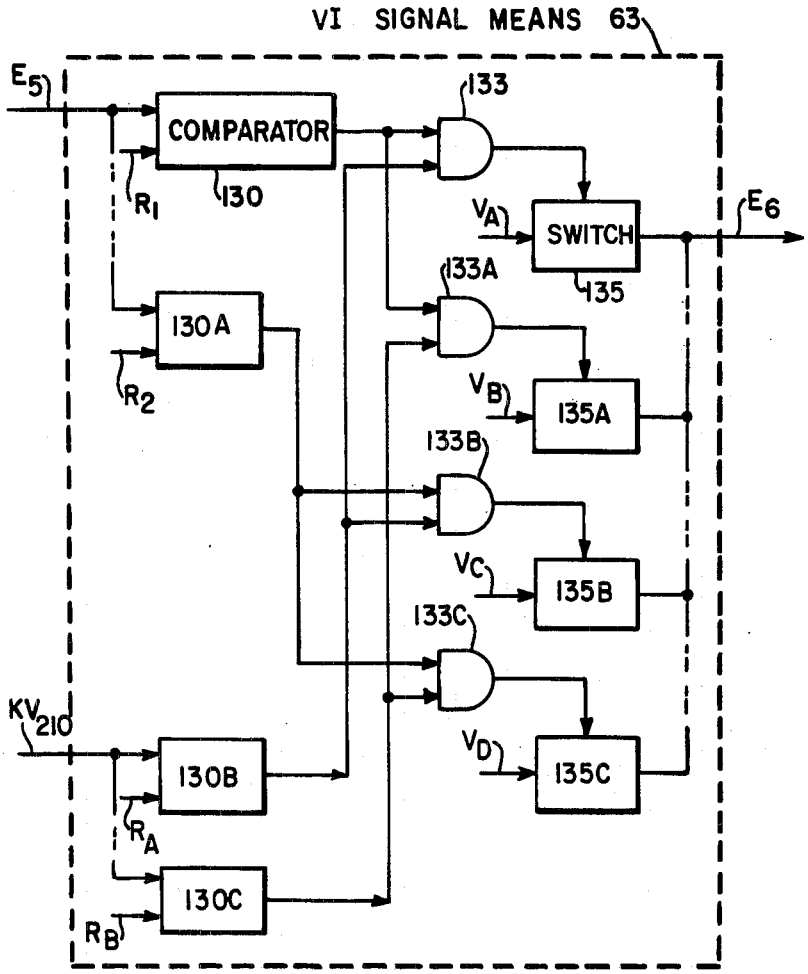

Referring now to FIG. 7, VI signal means 63 is essentially memory means which is addressed by signals $E_5$, corresponding to $KV_{100}$, and signal $KV_{210}$. In this regard, a comparator 130 and comparator 130A represent a plurality of comparators which receive signal $E_5$ and compare signal $E_5$ to reference voltages, represented by voltages $R_1$ and $R_2$, so as to decode signal $E_5$. Similarly, comparators 130B and 130C represent a plurality of comparators receiving signal $KV_{210}$ which compare signal $KV_{210}$ with reference voltages RA and RB so as to decode signal $KV_{210}$. The outputs from comparators 130 and 130B are applied to an AND gate 133 whose output controls a switch 135. Thus, should comparators 130 and 130B provide a high output, AND gate 133 is enabled and causes switch 135 to be rendered conductive to pass a direct current voltage $V_A$ corresponding to a predetermined value, as signal $E_6$ which corresponds to VI. Similarly, the outputs of comparators 130 and 130C control an AND gate 133A which in turn controls a switch 135A to pass or to block a direct current voltage $V_B$. Similarly, another AND gate 133B is controlled by the outputs from comparators 130A and 130B to control a switch 135B so as to pass or block a direct current voltage $V_C$. Again, an AND gate 133C is controlled by the outputs from comparators 130A and 130C to control a switch 135C to pass or to block a direct current voltage $V_D$. The outputs of switches 135 through 135C are tied together so as to provide a common output.

Figure 8:
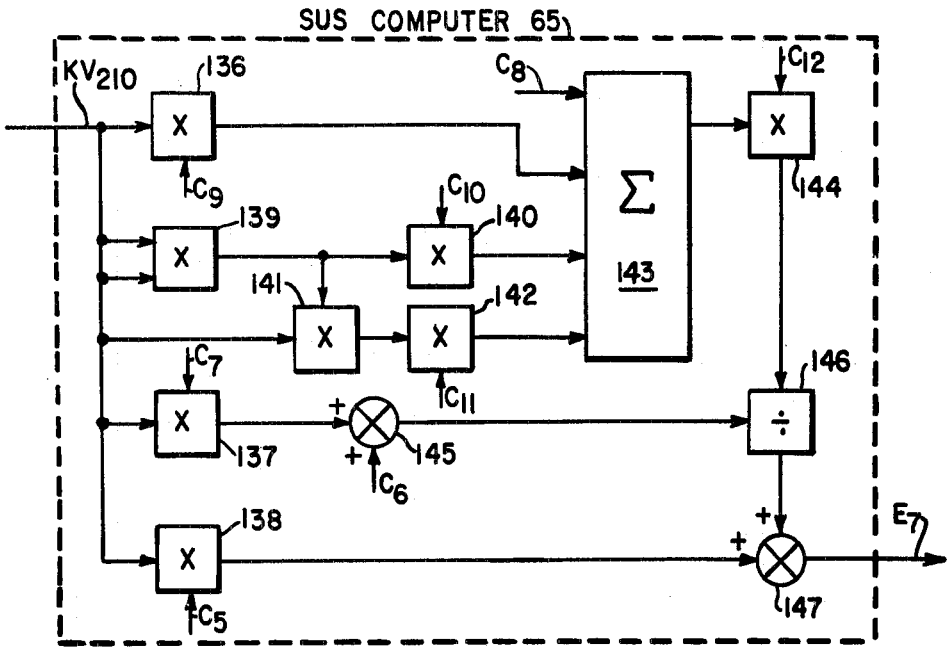

Referring now to FIG. 8, the SUS computer 65 includes multipliers 136, 137 and 138 multiplying signal $KV_{210}$ with direct current voltages $C_9$, $C_7$ and $C_5$, respectively, to provide signals corresponding to the terms $C_9(KV_{210})$, $C_7(KV_{210})$ and $C_5(KV_{210})$, respectively, in equation 6. A multiplier 139 effectively squares signal $KV_{210}$ to provide a signal to multipliers 140, 141. Multiplier 140 multiplies the signal from multiplier 139 with a direct current voltage $C_{10}$ to provide a signal corresponding to the term $C_{10}(KV_{210})^2$ in equation 6. Multiplier 141 multiplies the signal from multiplier 139 with signal $KV_{210}$ to provide a signal corresponding to $(KV_{210})^3$. A multiplier 142 multiplies the signal from multiplier 141 with a direct current voltage $C_{11}$ to provice a signal corresponding to the term $C_{11}(KV_{210})^3$ in equation 6. Summing means 143 sums the signals from multipliers 136, 140 and 142 with a direct current voltage $C_8$ to provide a signal to a multiplier 144 where it is multiplied with a direct current voltage $C_{12}$. The signal from multiplier 137 is summed with a direct current voltage $C_6$ by summing means 145 to provide a signal corresponding to the term $[C_6+C_7(KV_{210}]$. A divider 146 divides the signal provided by summing means 145 with the signal provided by multiplier 144 to provide a signal which is summed with the signal from multiplier 138 by summing means 147 to provide signal $E_7$.

Figure 9:
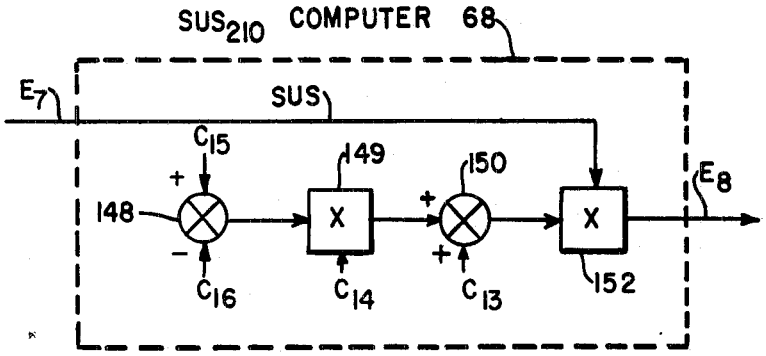

Referring now to FIG. 9, $SUS_{210}$ computer 68 includes subtracting means 148 which subtracts a direct current voltage $C_{16}$ from another direct current voltage $C_{15}$ to provide a signal corresponding to the term $(C_{15}-C_{16})$ in equation 7. The signal from subtracting means 148 is multiplied with a direct current voltage $C_{14}$ by a multiplier 149 to provide a product signal which is summed with another direct current voltage $C_{13}$ by summing means 150. Summing means 150 provides a signal corresponding to the term $[C_{13}+C_{14}(C_{15}-C_{16})]$ in equation 7. The signal from summing means 150 is multiplied with signal $E_7$ by a multiplier 152 to provide signal $E_8$.

Figure 10:
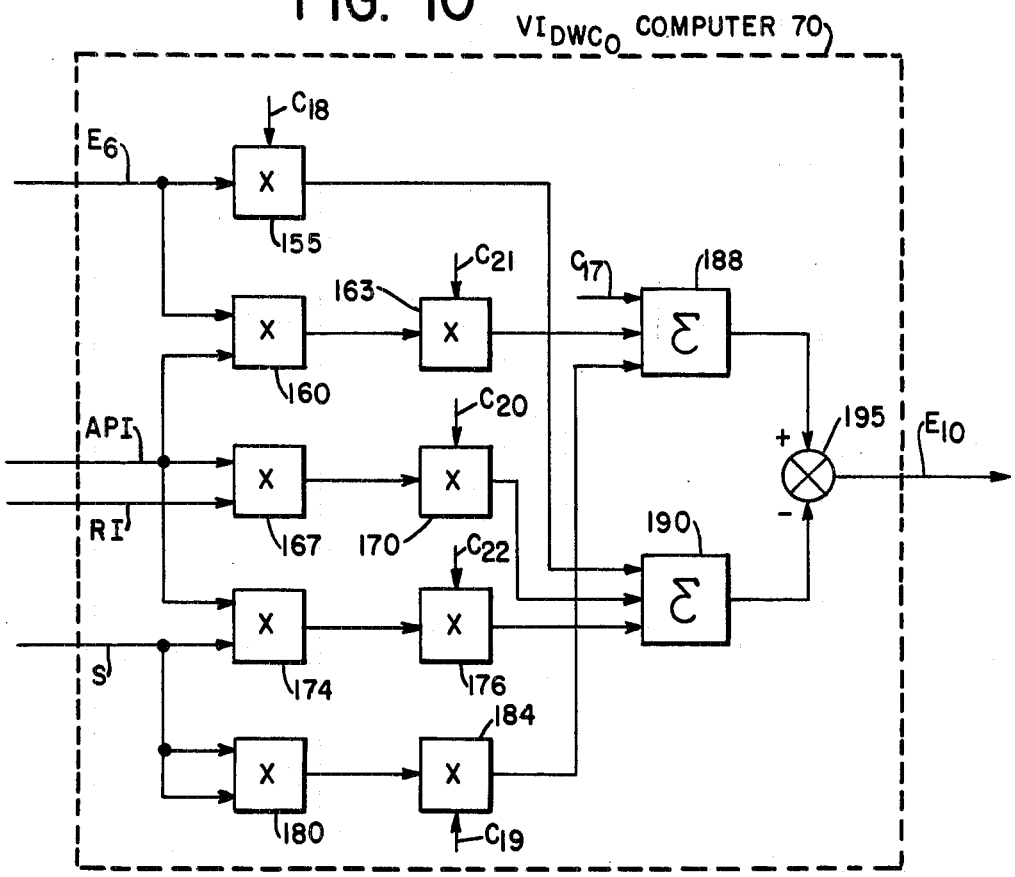

Referring now to FIG. 10, $VI_{DWCO}$ computer 70 includes a multiplier 155 multiplying signal $E_6$ with a direct current voltage $C_{18}$ to provide a signal corresponding to the term $C_{18}$(VI) in equation 8. A multiplier 160 multiplies signal $E_6$ and API to provide a signal to another multiplier 163 where it is multiplied with a direct current voltage $C_{21}$. Multiplier 163 provides a signal corresponding to the term $C_{21}$(API)(VI) in equation 8. A multiplier 167 multiplies signals API and RI to provide a signal which is multiplied with a direct current voltage $C_{20}$ by a multiplier 170 which provides a signal corresponding to the term $C_{20}$(RI)(API). Signals S and API are multiplied by a multiplier 174 to provide a signal to yet another multiplier 176 where it is multiplied with a direct current voltage $C_{22}$. Multiplier 176 provides a signal corresponding to the term $C_{22}$(API)(S). A multiplier 180 effectively squares signals S and provides a signal to another multiplier 184 where it is multiplied with direct current voltage $C_{19}$. Multiplier 184 provides a signal corresponding to the term $C_{19}(S)^2$.

Summing means 188 effectively sums the positive term in equation 8 by summing the signals from multipliers 163 and 184 with a direct current voltage $C_{17}$ to provide a sum signal. Multiplier 190 effectively sums the negative terms in equation 8 when it sums the signals from multipliers 155, 170 and 176 to provide a sum signal. Subtracting means 195 subtracts the sum signal provided by summing means 190 from the sum signal provided by summing means 188 to provide signal $E_{10}$.

Figure 11:
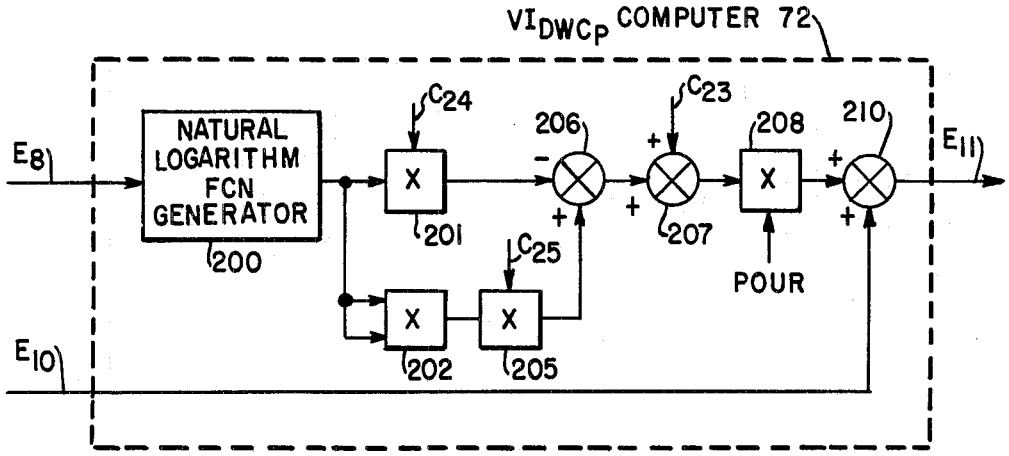

$VI_{DWCP}$ computer 72 shown in FIG. 11, includes a natural logarithm function generator 200 receiving signal $E_8$ and providing a signal corresponding to the term ln $SUS_{210}$ to multipliers 201 and 202. Multiplier 201 multiplies the signal from function generator 200 with a direct current voltage $C_{24}$ to provide a signal corresponding to the term $C_{24}$ ln $SUS_{210}$ in equation 9. Multiplier 202 effectively squares the signal from function generator 200 to provide a signal that is multiplied with the direct current voltage $C_{25}$ by a multiplier 205. Multiplier 205 provides a signal corresponding to the term $C_{25}(\ln SUS_{210})^2$ in equation 9. Subtracting means 206 subtracts the signals provided by multiplier 201 from the signal provided by multiplier 205. Summing means 207 sums the signal from subtracting means 206 with a direct current voltage $C_{23}$. A multiplier 208 multiplies the sum signals from summing means 207 with a direct current voltage POUR to provide a signal which is summed with signal $E_{10}$ by summing means 210 which provides signal $E_{11}$.

Figure 12:
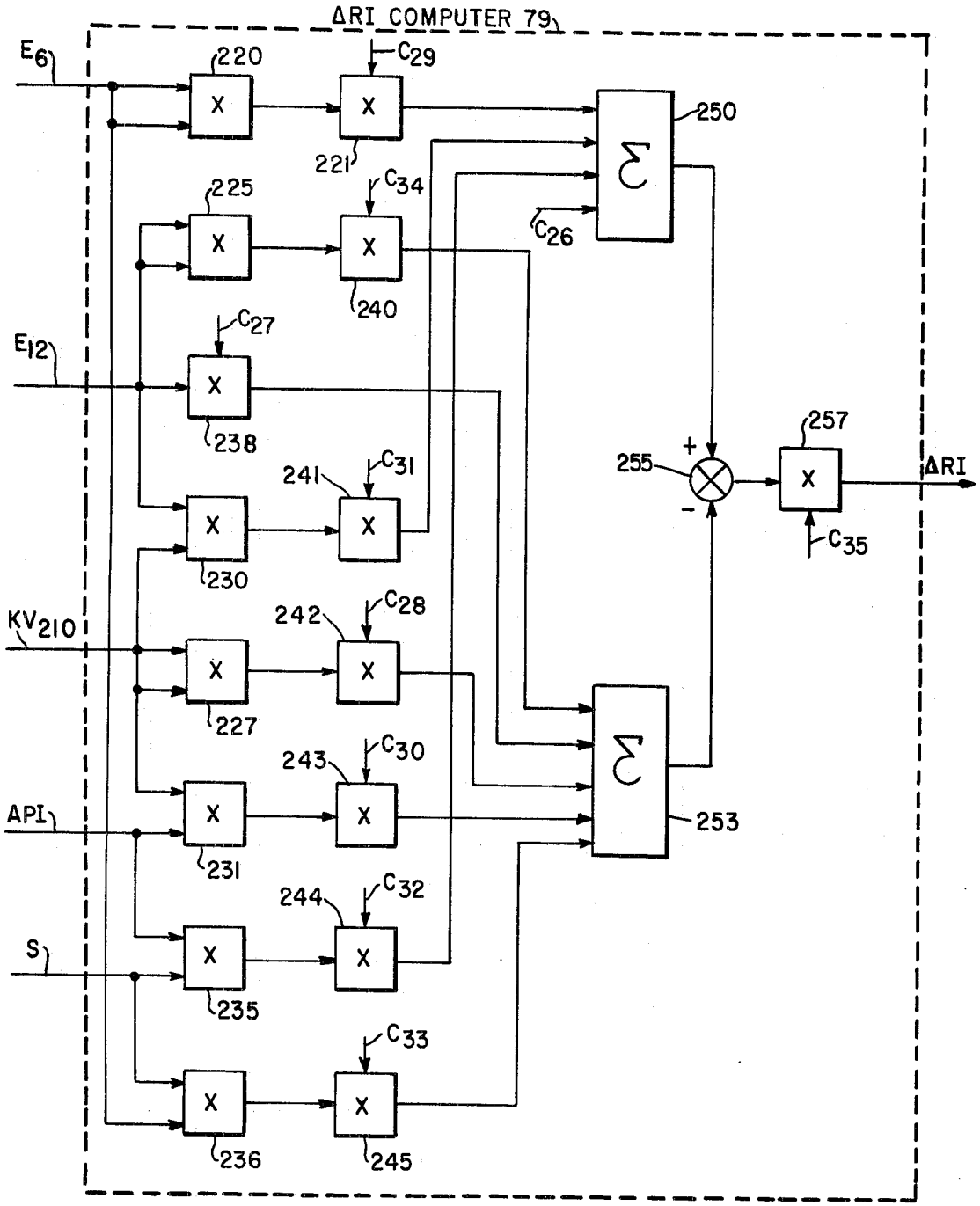

Referring now to FIG. 12, ΔRI computer 79 includes multipliers 220, 225 and 227 which effectively square signals $E_6$, $E_{12}$ and $KV_{210}$, respectively. Multipliers 230 and 231 multiply signal $KV_{210}$ with signals $E_{12}$ and API, respectively. Multipliers 235, 236 multiply signal S with signals API and $E_6$, respectively, to provide product signals while a multiplier 238 multiplies signal $E_{12}$ with a direct current voltage $C_{27}$ to provide a signal corresponding to the term $C_{27}(\Delta VI)$. Multipliers 221, 240, 241, 242, 243, 244 and 245 multiply the product signals from multipliers 220, 225, 230, 227, 231, 235 and 236, respectively, with direct current voltages $C_{29}$, $C_{34}$, $C_{31}$, $C_{28}$, $C_{30}$, $C_{32}$ and $C_{33}$, respectively, to provide signals corresponding to the term $C_{19}(VI)^2$, $C_{34}(\Delta VI)^2$, $C_{31}(\Delta VI)$, $C_{28}(KV_{210})^2$, $C_{30}(KV_{210})(API)$, $C_{32}(API)(S)$ and $C_{33}(VI)(S)$, respectively.

Summing means 250 effectively sums the positive terms of equation 11 and sum signals from multipliers 221, 241 and 244 with a direct current voltage $C_{26}$ to provide a sum signal. Summing means 253 effectively sums the negative terms of equation 11 when it sums the signals from multipliers 238, 240, 242 and 243 to provide a sum signal. Subtracting means 255 subtracts the signal provided by summing means 253 from the signal provided by summing means 250 to provide a signal to a multiplier 257. Multiplier 257 multiplies the signal with a direct current voltage $C_{35}$ to provide signal ΔRI.

Figure 13:
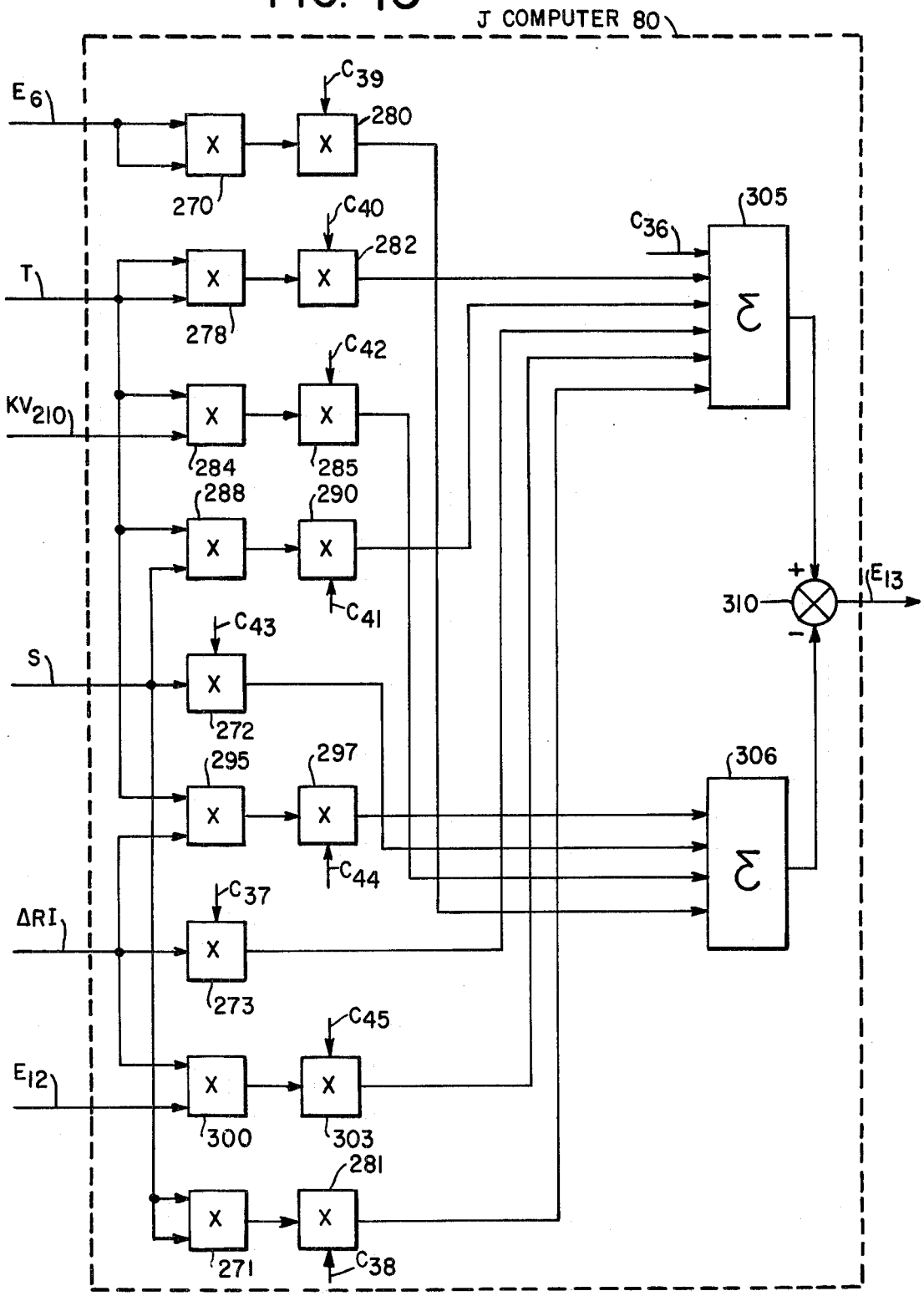

Referring now to FIG. 13, J computer 80 includes multipliers 272 and 273 multiplying signals S and ΔRI, respectively, with direct current voltages $C_{43}$ and $C_{37}$, respectively, to provide signals corresponding to the terms $C_{43}(S)$ and $C_{37}(\Delta RI)$, respectively, in equation 12. Multipliers 270, 271 and 278 effectively square signals $E_6$, S and T to provide signals to multipliers 280, 281 and 282, respectively, where they are multiplied with direct current voltages $C_{39}$, $C_{38}$ and $C_{40}$, respectively. Multipliers 280, 281 and 282 provide signals corresponding to the terms $C_{39}(VI)^2$, $C_3(S)^2$ and $C_{40}(T)^2$, respectively. Multiplier 284 multiplies signals T and $KV_{210}$ to provide a signal to a multiplier 285 where it is multiplied with a direct current voltage $C_{42}$. Multiplier 285 provides a signal corresponding to the term $C_{42}(KV_{210})(T)$ in equation 12. Signals S and T are multiplied by a multiplier 288 to provide a signal to yet another multiplier 290 where it is multiplied with a direct current voltage $C_{41}$. Multiplier 290 provides a signal corresponding to the term $C_{41}(S)(T)$. Signals T and ΔRI are multiplied by a multiplier 295 which provides a signal to a multiplier 297 where it is multiplied with a direct current voltage $C_{44}$ to provide a signal corresponding to the term $C_{44}(\Delta RI)(T)$. A multiplier 300 multiplies signals $E_{12}$ and ΔRI to provide a signal to a multiplier 303 where it is multipled with a direct current voltage $C_{45}$ which provides a signal corresponding to the term $C_{45}(\Delta VI)(\Delta RI)$ in equation 12.

Summing means 305 effectively sums all positive terms of equation 12 when it sums a direct current voltage $C_{36}$ with the signals from multipliers 273, 281, 282, 290 and 303 to provide a sum signal. A sum signal corresponding to the summation of the negative terms in equation 12 is provided by summing means 306 which sums the signals from multipliers 272, 280, 285 and 297. Subtracting means 310 subtracts the signal provided by summing means 306 from the signal provided by summing means 305 to create signal $E_{13}$.

The present invention as hereinbefore described controls an MP refining unit receiving medium sour charge oil to achieve a desired charge oil flow rate for a constant MP flow rate. It is also within the scope of the present invention, as hereinbefore described, to control the MP flow rate while the medium sour charge oil flow is maintained at a constant rate.

What is claimed is:

1. A control system for an N-methyl-2-pyrrolidone refining unit receiving medium sour charge oil and N-methyl-2-pyrrolidone solvent, one of which is maintained at a fixed flow rate while the flow rate of the other is controlled by the control system, treats the received medium sour charge oil with the received N-methyl-2-pyrrolidone to yield extract mix and raffinate, comprising gravity analyzer means for sampling the medium sour charge oil and providing a signal API corresponding to the API gravity of the medium sour charge oil, viscosity analyzer means for sampling the medium sour charge oil and providing signals $KV_{150}$ and $KV_{210}$ corresponding to the kinematic viscosities, corrected to 150° F. and 210° F., respectively, sulfur analyzer means for sampling the medium sour charge oil and providing a signal S corresponding to the sulfur content of the medium sour charge oil, a refractometer samples the medium sour charge oil and provides a signal RI corresponding to the refractive index of the medium sour charge oil, flow rate sensing means for sensing the flow rates of the medium sour charge oil and of the N-methyl-2-pyrrolidone and providing signals CHG and SOLV, corresponding to the medium sour charge oil flow rate and the N-methyl-2-pyrrolidone flow rate, respectively, temperature sensing means for sensing the temperature of the extract mix and providing a corresponding signal T, VI signal means connected to the viscosity analyzer means for providing a signal VI, corresponding to the viscosity index of the medium sour charge oil, in accordance with signals $KV_{150}$ and $KV_{210}$, ΔVI signal means connected to the gravity analyzer means, to the sulfur analyzer means, to the refractometer, to the viscosity analyzer means and to the VI signal means for providing a signal ΔVI corresponding to a difference between the viscosities of the medium sour charge oil and the refined oil in accordance with signals S, API, $KV_{210}$, RI and VI, ΔRI signal means connected to the gravity analyzer means, to the sulfur analyzer means, to the viscosity analyzer means, and to the ΔVI signal means for providing a signal corresponding to the difference between the refractive indexes of the medium sour charge oil and the refined oil, J signal means connected to the VI signal means, to the temperature sensing means, to the viscosity analyzer means, to the sulfur analyzer means, to the ΔRI signal means and to the ΔVI signal means for providing a signal J, corresponding to the N-methyl-2-pyrrolidone dosage, and control means connected to the J signal means and to the flow rate sensing means for providing a control signal in accordance with the J signal and one of the sensed flow rate signals, and apparatus means connected to the control means for controlling the one flow rate of the medium sour charge oil and N-methyl-2-pyrrolidone flow rates in accordance with the control signal.

2. A system as described in claim 1 in which the ΔVI signal means includes $SUS_{210}$ signal means connected to the viscosity analyzer means for providing a signal $SUS_{210}$ corresponding to the medium sour charge oil viscosity in Saybolt Universal Seconds corrected to 210° F.; and ΔVI network means connected to the gravity analyzer means, sulfur analyzer means, to the refractometer, to the VI signal means, to the J signal means and to the $SUS_{210}$ signal means and receiving voltage $VI_{RP}$ for providing signal $\Delta VI$ to the J signal means in accordance with signals VI, S, API, RI, $SUS_{210}$ and voltage $VI_{RP}$.

3. A system as described in claim 2 in which the $SUS_{210}$ signal means includes SUS signal means connected to the viscosity analyzer means, and receiving direct current voltages $C_5$ through $C_{12}$ for providing a signal SUS corresponding to an interim factor SUS in accordance with signal $KV_{210}$, voltages $C_5$ through $C_{12}$ and the following equation:

$$SUS=C_5(KV_{210})+[C_6+C_7(KV_{210})]/[C_8+C_9(KV_{210})+C_{10}(KV_{210})^2+C_{11}(KV_{210})^3](C_{12}),$$

where $C_5$ through $C_{12}$ are constants; and $SUS_{210}$ network means connected to the SUS signal means and to the $\Delta VI$ signal means and receiving direct current voltages $C_{13}$ through $C_{16}$ for providing signal $SUS_{212}$ to the $\Delta VI$ signal means in accordance with signal SUS, voltages $C_{13}$ through $C_{16}$ and the following equation:

$$SUS_{210}=[C_{13}+C_{14}(C_{15}-C_{16})]SUS,$$

where $C_{13}$ through $C_{16}$ are constants.

4. A system as described in claim 3 in which the VI signal means includes K signal means receiving direct current voltages $C_2$, $C_3$, $C_4$ and $T_{150}$ for providing a signal $K_{150}$ corresponding to the kinematic viscosity of the charge oil corrected to 150° F. in accordance with voltages $C_2$, $C_3$, $C_4$ and $T_{150}$, and the following equation:

$$K_{150}=[C_2-\ln(T_{150}+C_3)]/C_4,$$

where $C_2$ through $C_4$ are constants, and $T_{150}$ corresponds to a temperature of 150° F.; $H_{150}$ signal means connected to the viscosity analyzer means and receiving a direct current voltage $C_1$ for providing a signal $H_{150}$ corresponding to a viscosity H value for 150° F. in accordance with signal $KV_{150}$ and voltage $C_1$ in the following equation:

$$H_{150}=\ln\ln(KV_{150}+C_1),$$

where $C_1$ is a constant; $H_{210}$ signal means connected to the viscosity analyzer means and receiving voltage $C_1$ for providing signal $H_{210}$ corresponding to a viscosity H value for 210° F. in accordance with signal $KV_{210}$, voltage $C_1$ and the following equation:

$$H_{210}=\ln\ln(KV_{210}+C_1),$$

$H_{100}$ signal means connected to the K signal means, to the $H_{150}$ signal means and the $H_{210}$ signal means for providing a signal $H_{100}$ corresponding to a viscosity H value for 100° F., in accordance with signals $H_{150}$, $H_{210}$ and $K_{150}$ and the following equation:

$$H_{100}=H_{210}+(H_{150}-H_{210})/K_{150},$$

$KV_{100}$ signal means connected to the $H_{100}$ signal means and receiving voltage $C_1$ for providing a signal $KV_{100}$ corresponding to a kinematic viscosity for the charge oil corrected to 100° F. in accordance with signal $H_{100}$, voltage $C_1$, and the following equation:

$$KV_{100}=\exp[\exp(H_{100})]-C_1,$$

and VI memory means connected to the $KV_{100}$ signal means and to the viscosity analyzer means having a plurality of signals stored therein, corresponding to different viscosity indexes and controlled by signals $KV_{100}$ and $KV_{210}$ to select a stored signal and providing the selected stored signal as signal VI.

5. A system as described in claim 4 in which the $\Delta VI$ network means includes a $VI_{DWCO}$ signal means connected to the gravity analyzer means, the sulfur analyzer means, the refractometer, and the VI signal means, and receives direct current voltages $C_{17}$ through $C_{22}$ and provides a signal $VI_{DWCO}$ in accordance with signals RI, VI, S and API, voltages $C_{17}$ through $C_{22}$ and the following equation:

$$VI_{DWCO}=C_{17}-C_{18}(VI)+C_{19}(S)^2-C_{20}(RI)(API)+C_{21}(API)(VI)C_{22}(API)(S),$$

where $C_{17}$ through $C_{22}$ are constants; a $VI_{DWCP}$ signal means connected to the $VI_{DWCO}$ signal means and to the $SUS_{210}$ signal means for providing a $VI_{DWCP}$ signal in accordance with signals $SUS_{210}$ and $VI_{DWCO}$, voltages $C_{23}$ through $C_{25}$ and Pour, and the following equation:

$$VI_{DWCP}=VI_{DWCO}+(POUR)[C_{23}-C_{24}\ln SUS_{210}+C_{25}(\ln SUS_{210})^2],$$

where $C_{23}$ through $C_{25}$ are constants, and subtracting means connected to the J signal means and to the $VI_{DWCP}$ signal means and receiving voltage $VI_{RP}$ for subtracting signal $VI_{DWCP}$ from voltage $VI_{RP}$ to provide the $\Delta VI$ signal to the J signal means.

6. A system as described in claim 5 in which the $\Delta RI$ signal means receives direct current voltages corresponding to constants $C_{26}$ through $C_{35}$ and provides signal $\Delta RI$ in accordance with the received voltages, signals $\Delta VI$, $KV_{210}$, VI, API and S and the following equation:

$$\Delta RI=[C_{26}-C_{27}(\Delta VI)-C_{28}(KV_{210})^2+C_{29}(VI)^2-C_{30}(KV_{210})(API)+C_{31}(\Delta VI)(KV_{210})+C_{32}(API)(S)-C_{33}(VI)(S)-C_{34}(\Delta VI)^2]C_{35}.$$

7. A system as described in claim 6 in which the J signal means receives direct current voltages corresponding to constants $C_{36}$ through $C_{45}$ and provides the J signal in accordance with the received direct current voltages, signals $\Delta RI$, S, VI, T, $KV_{210}$ and $\Delta VI$, and the following equation:

$$J=C_{36}+C_{37}(\Delta RI)+C_{38}(S)^2-C_{39}(VI)^2-C_{40}(T)^2+C_{41}(S)(T)-C_{42}(KV_{210})(T)-C_{43}(S)-C_{44}(\Delta RI)(T)+C_{45}(\Delta RI)(\Delta VI).$$

8. A system as described in claim 7 in which flow rate of the medium sour charge oil is controlled and the flow of the N-methyl-2-pyrrolidone is maintained at a constant rate and the control means receives signal SOLV from the flow rate sensing means, the J signal from the J signal means and a direct current voltage corresponding to a value of 100 and provides a signal C to the apparatus means corresponding to a new medium sour charge oil flow rate in accordance with the selected J signal, signal SOLV and the following equation:

$$C=(SOLV)(100)/J,$$

so as to cause the apparatus means to change the medium sour charge oil flow to the new flow rate.

9. A system as described in claim 7 in which the controlled flow rate is the N-methyl-2-pyrrolidone flow rate and the flow of the medium sour charge oil is maintained constant, and the control means is connected to the sensing means, to the J signal means and receives a direct current voltage corresponding to the value of 100 for providing a signal SO corresponding to a new N-methyl 2-pyrrolidone flow rate in accordance with signals CHG and the J signal and the received voltage, and the following equation:

$$SO=(CHG)(J)/100,$$

so as to cause the N-methyl-2-pyrrolidone flow to change to the new flow rate.

* * * * *